US005207040A

United States Patent [19]

Lovell

[11] Patent Number: 5,207,040

[45] Date of Patent: May 4, 1993

[54] INTERIOR INSULATING WINDOW

[76] Inventor: William J. Lovell, P.O. Box 6905, St. Louis, Mo. 63123

[21] Appl. No.: 740,597

[22] Filed: Aug. 5, 1991

[51] Int. Cl.[5] ..... E04C 2/00

[52] U.S. Cl. ..... 52/204.5; 52/214; 52/216; 52/397

[58] Field of Search ..... 52/204, 214, 397, 202, 52/656, 216, 217

[56] References Cited

U.S. PATENT DOCUMENTS 4,486,990 12/1984 Bauch ..... 52/202

4,999,958 3/1991 Harrison ..... 52/214

*Primary Examiner*—David A. Scherbel

*Assistant Examiner*—Matthew E. Leno

[57] ABSTRACT

An interior insulating window having a rigid frame extending about the perimeter of the window, the outer edge of said frame having foam strips mounted which provide a sealing edge. The aformentioned frame which may be composed of a variety of materials with little or no consideration to respected weights. The window to be inserted in said frame may be of a variety of transparent, semi-transparent, or opaque material with little or no consideration to respected weights. A system held in a vertical position within an existing window casing by the force exerted by the compressed foam strips on the top and side of the frame. Whereas thinner passive foam strips are mounted to the bottom and remaining side of the frame to complete a sealing edge about the perimeter of the frame. Whereas the aforementioned foam strips are composed of a material having sufficient indentation loan deflection and density to provide an adequate sealing edge. Since weight is not a limiting factor, modifications may be made to the basic window frame in favor of more ornate designs. The possible variety in designs offered to a perspective consumer make this system more marketable by comparison.

9 Claims, 2 Drawing Sheets

INTERIOR INSULATING WINDOW

BACKGROUND

The object of the present invention is to provide a reusable window insulating system, which will not impose on the attributes of the existing window. At present, prior art which does not have a permanent mount to the existing window casing make use of light weight construction materials. The INTERIOR STORM WINDOW, by Thomas Sixsmith, U.S. Pat. No. 4,599,825 makes use of a thin acrylic glazing mounted in an extruded plastic frame. This design minimizes the weight on the flexible plastic sealing edge. The edge which is mounted on the perimeter of the frame holds the system in a vertical position within a window casing. In addition, the sealing edge may be affected by a window casing which is not smooth and/or horizontal. As noted by Sixsmith, a wedge addition may be needed to provide a better seal. The REMOVABLE WINDOW INSULATION SYSTEM, by Tamil D. Bauch, U.S. Pat. No. 4,485,990 makes use of a light weight foam insulating board. The weight of which will not compress the foam strip sealing edge. The foam edge which is mounted on the perimeter of the foam insulating board, holds the system in a vertical position within a window casing. The utility of said foam strip would be compromised if a heavier material were used in place of the foam insulating board. When inserted into a window casing, the nature of the material used in this system defeats the attributes of the existing window. Thus, the utility of existinq systems which have no permanent mounting is limited. The weight of material used in their construction being held in consideration with regard to the sealing edges.

SUMMARY

It is the purpose of the present invention to provide a system whose construction and utility is not limited by the weight of materials used. With an increasing emphasis towards recycling, the scope of materials, regardless of their respected weights, has increased. Recycled aluminum or plastic would satisfy the component requirements of the present invention. Allowances for differences may be made to the basic window frame design in favor of more ornate styles of frames which would not be limited by the weight of said material. In addition to the system saving heating and cooling costs, the characteristics of the existing window are maintained. Since a permanent mount to an existing window frame is not required, the integrity of the original building construction is preserved. A factor to be considered by tenants of lease held property.

DETAILED DESCRIPTION

Figure 1:
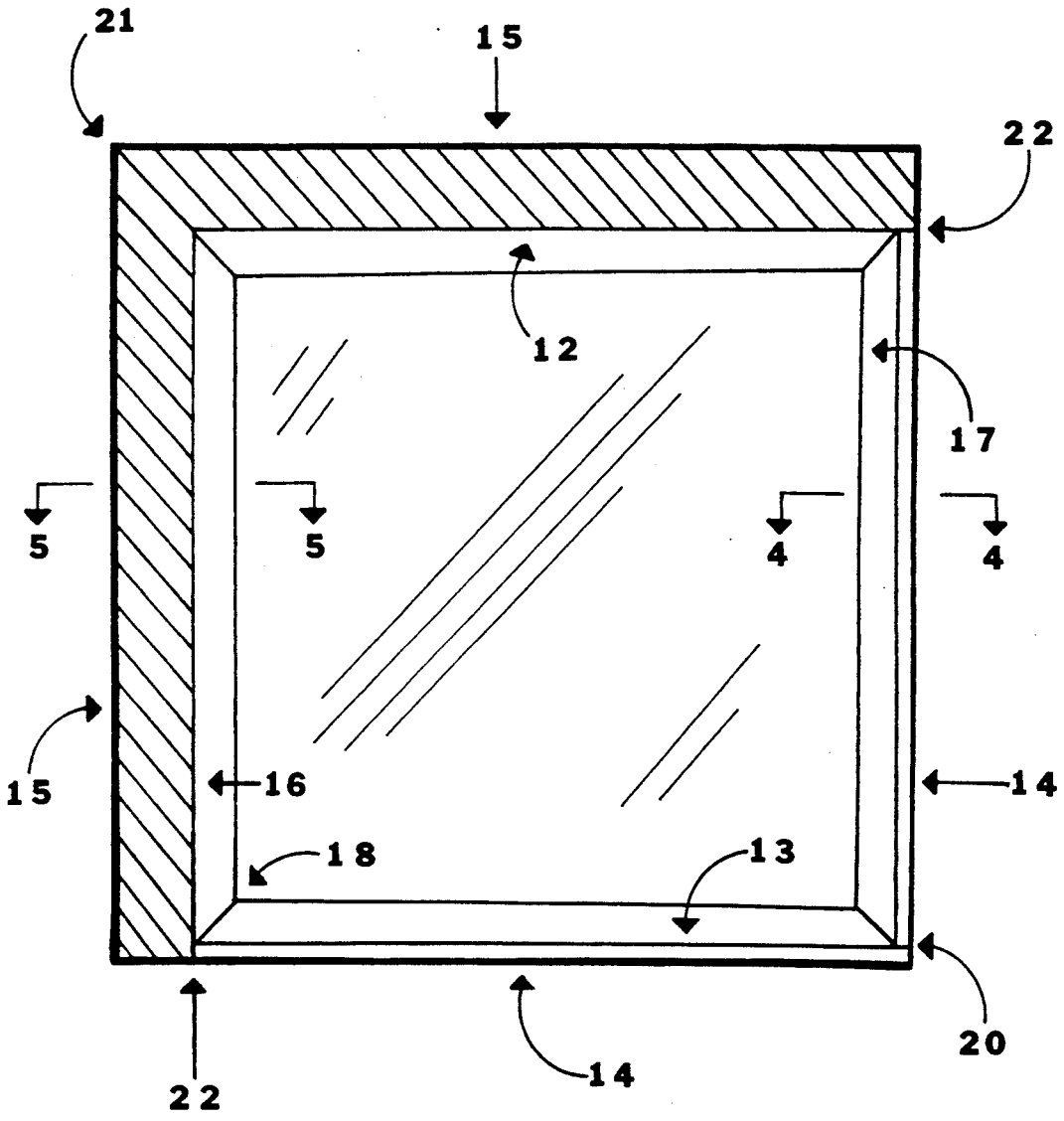
FIG. 1 is the assembled system. The most notable feature being the difference of thickness between the foam strips attached on opposing sides of the frame.
Figure 2:
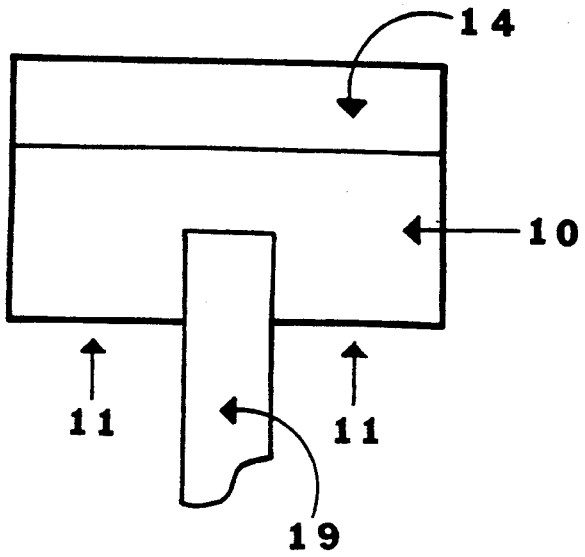
FIG. 2 is a cross-sectional view taken along line 4—4 of FIG. 1.
Figure 3:
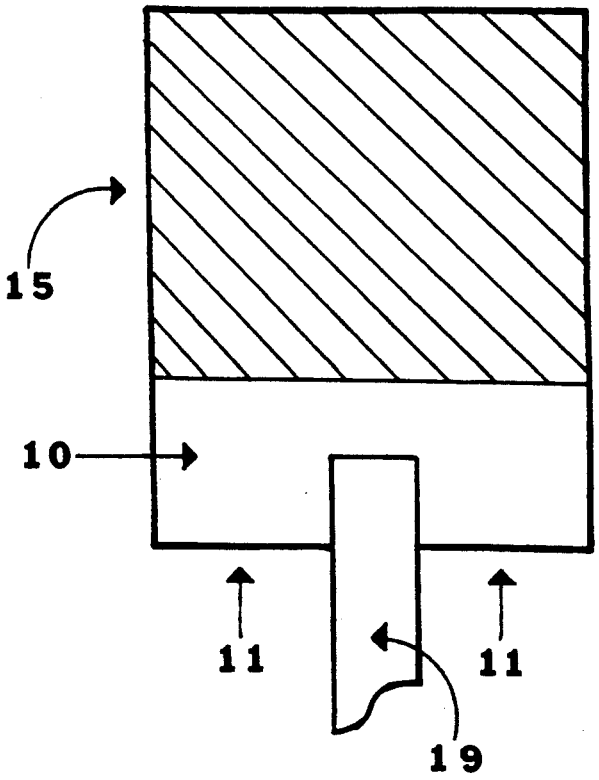
FIG. 3 is a cross-sectional view taken along line 5—5 of FIG. 1.

In reference to the drawings, FIG. 2 and FIG. 3 depict a basic design for the window frame 10. The composition of said frame may be made of wood, plastic, or metal. In reducing the idea to practice, two modes were constructed. One frame composed of red oak wood. The other was made of a solid poiyvinylchloride bar. The weight of each material proved not to be detrimental to the purpose and stability of the system. The width of the frame shall be determined by the sum of the thickness of the window plus a one-half inch or greater width 11 for ease of handling on both sides of the window. The depth of the frame shall make allowances for the depth of the glass channel plus a suitable amount for overall support. In reference to FIG. 1, the length of the top rail of the frame 12 and bottom rail of the frame 13 shall be determined by the sum of the width of the existing window casing less the thickness of the small foam strip 14, a illustrated in FIG. 2, less one-half the thickness of the larger foam strip 15, as illustrated in FIG. 3. Accordingly, the same calculation is made in determining the length of the left side rail of the frame 16 and the right side rail of the frame 17, as depicted in FIG. 1. Each end of said rails are mitered at a forty-five degree, 45°, angle. When the ends are joined, a ninety degree, 90°, joint (18) will be made with opposing glass channels facing each other, as shown in FIG. 1. Before joining the corners of the frame, the window 19 is inserted into the glass channels, reference to FIG. 2 and FIG. 3. In reducing the idea to practice a clear cast acrylic sheet, one-eighth, ⅛, inch thick was employed. Since weight is not a limiting factor to the system's utility, a variety of sheet materials with a range of thickness may be considered in the construction of this component. With the window in place, the corners of the frame are joined together, as illustrated in FIG. 1. The thinner of the foam pads 14 is now joined to the bottom of the frame 13 and to one side of the frame 17, as illustrated in FIG. 1. The location of these strips is a key factor in the design of the system. The bottom strip is used to support the weight of the system. Compression of said strip by the weight of the system will not detrimentally affect the function of the thicker strip mounted on the top of the frame. The thinner strip attached to one side of the frame will allow ease of insertion or extraction of the system in an existing window casing due to its passive nature. The system is maneuvered when the thicker foam strips are compressed against to top and side of the aforementioned window casing.

The length of the strip attached to one side of the frame 14, will be the exact length of said frame 17, refer to FIG. 1.

The length of the strip attached to the bottom of the frame 14, is the sum of said frame 13 plus the thickness of the smaller foam pad. Thus when attached, the bottom pad will overlap the side foam pad 20, as illustrated in FIG. 1.

The thicker of the foam pads 15, as shown in FIG. 3, is now attached to the top rail 12 and the remaining side rail 16 of the frame. When the system is placed in the window casing, the pressure exerted by the compressed foam will hold the system in a vertical position within a window casing and form a seal about its perimeter. The length of each is dependent on the sum of the length of the frame plus the thickness of the thicker foam pad and the thickness of the smaller foam pad. As depicted in FIG. 1, one end of each foam strip is mitered at a forty-five degree, 45°, angle, thus, a ninety degree, 90°, joint is formed when the ends are joined together 21, as illustrated in FIG. 1. Thus, when affixed to the top and side rail of the frame, no undue stress, as would be associated with bending a single strip around the corner for the purpose of conforming to the shape, will be developed. The square, end of the foam strips will overlap the thinner foam edge strips providing a suitable sealing edge for the system 22, as illustrated in FIG. 1.

In reducing the idea to practice, a polyurethane foam sheet was used, with an identation loan deflection of 32–36 I.L.D. (Firm). The density of the foam was 1.5–1.7 lbs. (Medium). A hexane base adhesive was used to join the foam strips to each other and to the rails of the window frame. Thus, it will be seen that I have provided an interior insulating window. A system which will not require permanent mounting to an existing structure and can be easily installed in an existing window casing. An invention, that when manufactured, may have components consisting of a variety of materials; the weight of said materials not being a limiting factor. Since I have presented and described a single specific embodiment of my invention, it will be noted that this is by way of illustration only. Various changes and modifications may be considered within the context of the following claims.

I claim:

1. In combination with an existing window casing, an interior insulating window comprising:

a. a rigid frame extending around the perimeter of a window pane, said frame comprising a top rail, a bottom rail, a first side rail and a second side rail, b. a distinct foam strip of a first thickness secured along the periphery of each of said top rail and said first side rail, c. a distinct foam strip of a second thickness secured along the periphery of each of said bottom rail and said second side rail, said first thickness being greater than said second thickness, d. said casing comprising dimensions greater than said frame such that when said foam strips of first thickness are compressed said frame may be inserted into said casing with said foam strips providing a friction fit as well as an insulating barrier extending from said casing to said frame when in an inserted position, e. said foam strips of second thickness being of a thickness which would not hinder insertion of said frame into said casing when said foam strips of first thickness are compressed, and being of sufficient thickness as to prevent compression, due to the weight of the window and the frame, of said foam strips of second thickness to a point which would adversely affect the friction fit of said foam strips of said first thickness.

2. The combination as recited in claim 1 wherein the rails of said frame are composed of wood.

3. The combination as recited in claim 1 wherein the rails of said frame are composed of metal.

4. The combination as recited in claim 1 wherein the rails of said frame are composed of plastic.

5. The combination as recited in claim 1 wherein said window pane is composed of a transparent material.

6. The combination as recited in claim 1 wherein said window pane is composed of a semi-transparent material.

7. The combination as recited in claim 1 wherein said window pane is composed of a opaque material.

8. The combination as recited in claim 1 wherein the foam strips mounted to said top rail and said first side rail of said frame are composed of a resilient material which will provide a friction fit as well as an insulating barrier extending from said casing to said frame when in an inserted position.

9. The combination as recited in claim 1 wherein the foam strips mounted to said bottom rail and said second side rail of said frame are composed of a resilient material which will provide a friction fit as well as an insulating barrier extending from said casing to said frame when in an inserted position.

* * * * *